US006591517B1

(12) United States Patent
Moore

(10) Patent No.: US 6,591,517 B1
(45) Date of Patent: Jul. 15, 2003

(54) SHOE DRYER

(76) Inventor: Burt T. Moore, 2667 Harrison St., Beaumont, TX (US) 77702

( * ) Notice: Subject to any disclaimer, the term of this patent is extended or adjusted under 35 U.S.C. 154(b) by 0 days.

(21) Appl. No.: 10/255,783

(22) Filed: Sep. 25, 2002

(51) Int. Cl.[7] ..... F26B 25/00
(52) U.S. Cl. ..... 34/106; 34/104; 34/202
(58) Field of Search ..... 34/90, 103, 104, 34/106, 107, 201, 202, 209, 210, 215, 239, 109, 235

(56) References Cited

U.S. PATENT DOCUMENTS

| | | | | | |
|---|---|---|---|---|---|
| 3,154,392 | A | * | 10/1964 | Littman | 34/104 |
| 3,256,616 | A | * | 6/1966 | McGoldrick | 34/104 |
| 3,798,788 | A | * | 3/1974 | Kuntz | 34/104 |
| 4,200,993 | A | * | 5/1980 | Blanc et al. | 34/104 |
| 4,530,168 | A | * | 7/1985 | Petre | 34/106 |
| 4,727,656 | A | * | 3/1988 | Jannach et al. | 34/104 |
| 5,199,188 | A | * | 4/1993 | Franz | 34/105 |
| 5,412,928 | A | * | 5/1995 | Reithel | 34/104 |
| 5,729,908 | A | * | 3/1998 | Braden | 34/104 |

FOREIGN PATENT DOCUMENTS

| | | | | |
|---|---|---|---|---|
| JP | 04276230 A | * | 10/1992 | A47L/23/20 |
| JP | 06038918 A | * | 2/1994 | A47L/23/20 |

* cited by examiner

*Primary Examiner*—Ira S. Lazarus
*Assistant Examiner*—Andrea M. Ragonese

(57) ABSTRACT

The present invention is a shoe dryer and deodorizer that can be hung on the back of a door or mounted on a wall. It is comprised of an upper housing support member that is attached to a flat shoe rack with mesh pockets with which to hold shoes. The upper housing support member contains a motorized fan assembly, an air intake screen, a deodorizing filter, and an air discharge duct. The motorized fan assembly is comprised of a fan intake duct, a blower, a baffle, and a fan discharge duct. Air is taken into the unit through the intake screen and passes through the deodorizing filter and the fan intake duct on its way to the fan blower. The fan blower pushes this air through the baffle and the fan discharge duct and out to the air discharge duct where the air is dispersed over the shoes that are placed in the mesh pockets. The unit can have a manual power switch or can be programmed by a timer mechanism to turn on and off.

17 Claims, 3 Drawing Sheets

SHOE DRYER

BACKGROUND OF THE INVENTION

1. Field of the Invention

The present invention relates to a shoe dryer for use in connection with drying and deodorizing shoes after use. The shoe dryer has particular utility in connection with drying moisture in shoes after wearing them for a long period of time. It also helps to kill bacteria that is trapped in the moisture and thus has utility in deodorizing shoes as well.

2. Description of the Prior Art

Shoe dryers are desirable for quickly drying shoes when they become moist from perspiration or inclement weather. A shoe dryer allows one to quickly dry shoes so that they can be worn immediately. A shoe dryer also discourages bacteria to breed in the moist interior of the shoes thus eliminating disease and odor. Drying shoes immediately also contributes to a longer lifetime for the shoes since moisture contributes to material deterioration of shoes.

The use of dehumidifier devices is known in the prior art. For example, U.S. Pat. No. 3,798,788 to Kuntz discloses a shoe and glove drying apparatus that consists of a hollow middle member with arms extending outwardly to place the shoes or gloves on. However, the Kuntz '788 patent does not have the ability to deodorize shoes, and has further drawbacks of being unable to be stored in a convenient place that is out of the way.

U.S. Pat. No. 5,412,928 to Reithel discloses a dehydration device that is used to remove moisture from clothes, shoes and gloves. However, the Reithel '928 patent does not deodorize shoes, and additionally is not compact enough to store easily.

Similarly, U.S. Pat. No. 4,787,153 to Chen discloses a shoe dryer that removes moisture from shoes. However, the Chen '153 patent does not deodorize shoes, and can only be used to dry one pair of shoes at a time, whereas the present invention can dry multiple pairs of shoes at a time.

Lastly, U.S. Pat. No. 5,666,743 to Dawson discloses an apparel drying and deodorizing system that dries and deodorizes moist shoes and apparel. However, the Dawson '743 patent is not easily storable, and has the additional deficiency of being unable to dry and store multiple pairs of shoes at one time.

While the above-described devices fulfill their respective, particular objectives and requirements, the aforementioned patents do not describe a shoe dryer that allows for drying and deodorizing multiple pairs of shoes as well as storing them in a convenient place. The aforementioned patents describe devices that are bulky and occupy a considerable amount of space. The present invention can be mounted on a wall or door to occupy the least amount of space possible. In addition, it can be used as a shoe rack to store shoes when not in use thus providing even more free space in a person's home. Few of the aforementioned patents contain deodorizing filters to help deodorize shoes while they are being dried. The present invention contains a deodorizing filter that ensures that the air being blown across the shoes is deodorized. Therefore, a need exists for a new and improved shoe dryer that can be used for drying and deodorizing multiple pairs of shoes as well as storing them. In this regard, the present invention substantially fulfills this need. In this respect, the shoe dryer according to the present invention substantially departs from the conventional concepts and designs of the prior art, and in doing so provides an apparatus primarily developed for the purpose of drying and deodorizing shoes as well as storing them.

SUMMARY OF THE INVENTION

In view of the foregoing disadvantages inherent in the known types of dehumidifier devices now present in the prior art, the present invention provides an improved shoe dryer, and overcomes the above-mentioned disadvantages and drawbacks of the prior art. As such, the general purpose of the present invention, which will be described subsequently in greater detail, is to provide a new and improved shoe dryer which has all the advantages of the prior art mentioned heretofore and many novel features that result in a shoe dryer which is not anticipated, rendered obvious, suggested, or even implied by the prior art, either alone or in any combination thereof.

To attain this, the present invention essentially comprises a device with a motorized fan assembly attached to a flat shoe rack with mesh pockets within which to place shoes. The device could be mounted to a wall or hung over a door so as to be stored in a convenient place. A power switch would be located at the top of the housing for the fan assembly. The power switch is connected to a power cord that can be plugged into any outlet to provide an electrical current to the device. When the power switch is engaged, air comes in through the air intake screen and passes through a deodorizing filter on its way into a fan intake duct. The air passes through the fan intake duct and is circulated through a fan blower. The fan blower blows the air through a baffle and out a fan discharge duct to an air discharge duct, which in turn blows the deodorized air across the shoes. When the unit is not in use, shoes can be stored within the mesh pockets. The unit is preferably three to five feet long, with the blower unit being approximately one foot long. The unit is approximately three feet wide and six to twelve inches deep.

There has thus been outlined, rather broadly, the more important features of the invention in order that the detailed description thereof that follows may be better understood and in order that the present contribution to the art may be better appreciated.

The invention may also include an optional timer mechanism to turn the device on and off automatically as opposed to the manual power switch. Additionally, the blower unit could be manufactured in different sizes. The shoe rack itself could be manufactured in different sizes to house different numbers of shoes. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved shoe dryer that has all of the advantages of the prior art dehumidifier devices and none of the disadvantages.

It is another object of the present invention to provide a new and improved shoe dryer that may be easily and efficiently manufactured and marketed.

An even further object of the present invention is to provide a new and improved shoe dryer that has a low cost of manufacture with regard to both materials and labor, and which accordingly is then susceptible of low prices of sale to the consuming public, thereby making such shoe dryer economically available to the buying public.

Still another object of the present invention is to provide a new shoe dryer that provides in the apparatuses and methods of the prior art some of the advantages thereof, while simultaneously overcoming some of the disadvantages normally associated therewith.

Even still another object of the present invention is to provide a shoe dryer for drying and deodorizing multiple pairs of shoes as well as storing them. Drying shoes prevents moisture from being trapped in shoes and breeding bacteria that could lead to disease and odor. Moist shoes also lead to material deterioration. Drying shoes quickly will also help extend the life of the shoes.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
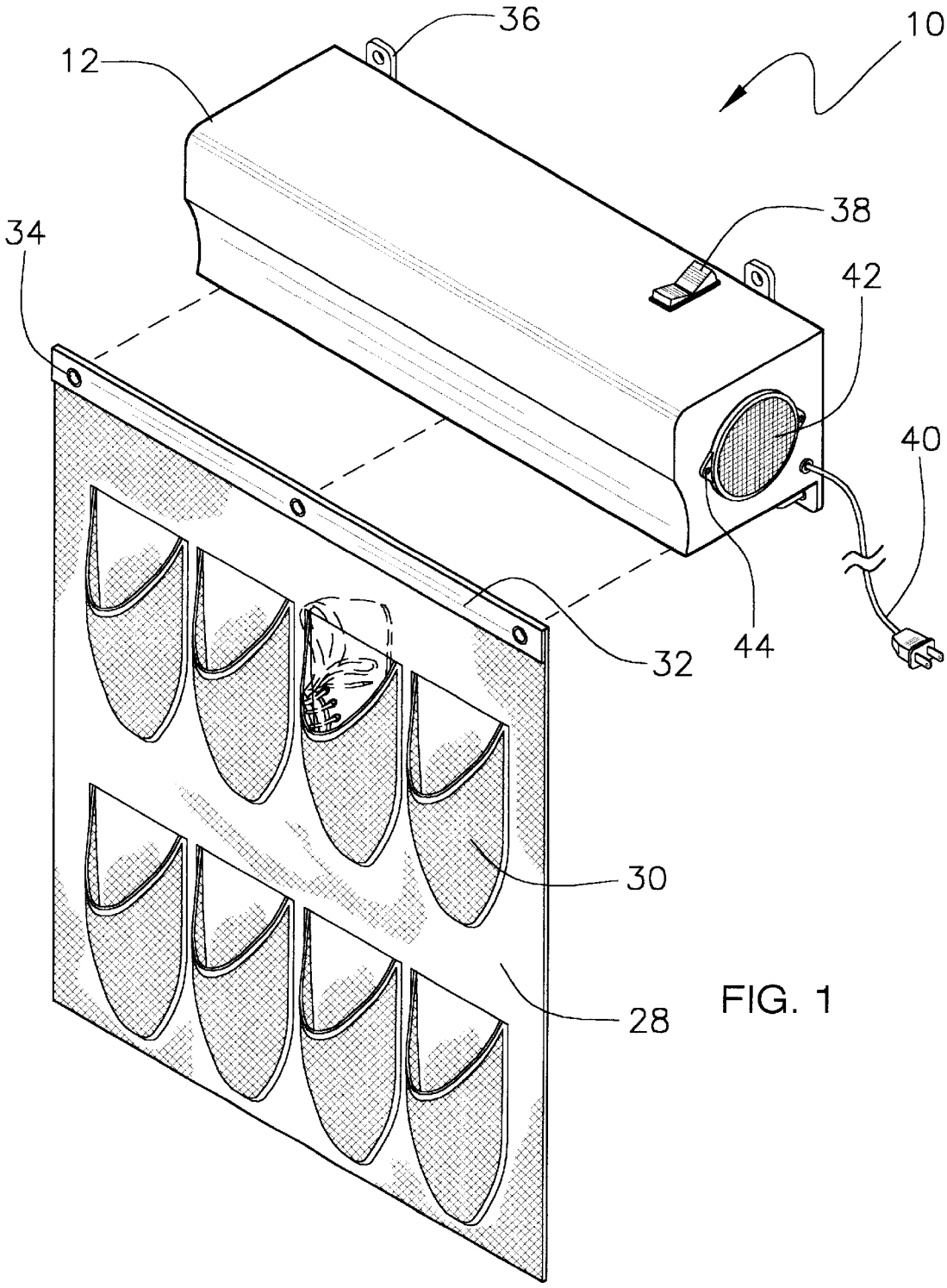
FIG. 1 is a top right perspective view of the preferred embodiment of the shoe dryer constructed in accordance with the principles of the present invention.

Referring now to the drawings, and particularly to FIGS. 1–4, a preferred embodiment of the shoe dryer of the present invention is shown and generally designated by the reference numeral 10.

In FIG. 1, a new and improved shoe dryer 10 of the present invention for drying and deodorizing shoes is illustrated and will be described. More particularly, the shoe dryer 10 has an upper housing support member 12 that is attached to a flat planar support member 34. The flat planar support member 34 contains a plurality of mesh pockets 36 within which to place shoes. A hangar bar 38 with a plurality of attachment slots 40 is attached to the top of the flat planar support member 34. The hangar bar 38 is preferably made of metal and extends the full width of the flat planar support member 34. Hangar hooks 32 are located on the flange 30 and extend outwardly therefrom. The flat planar support member 34 is directly attached to the upper housing support member 12 through the protrusion of the hangar hooks 32 through the attachment slots 40 in the hangar bar 38. When attached in this fashion, the flat planar support member 34 hangs directly below the upper housing support member 12. The upper housing support member 12 has at least two mounting brackets 42 connected to its top end. These mounting brackets 42 are used to attach the shoe dryer 10 to a wall or a door. The mounting brackets 42 can be manufactured of metal, heavyweight plastic, or any other suitable material. The mounting brackets 42 are square-shaped with a round aperture in the center for a mounting screw to be placed. The upper housing support member 12 contains a generally circular air intake screen 14 through which air is received into the shoe dryer 10. The air intake screen 14 is held in place and removably attached by screws 48 that fit into matching attachment points 50 in the upper housing support member 12. The shoe dryer 10 can be manufactured in a variety of sizes and colors. The preferred overall height of the shoe dryer 10 is three to five feet with a width of thirty-two to thirty-six inches and a depth of six to ten inches.

Figure 2:
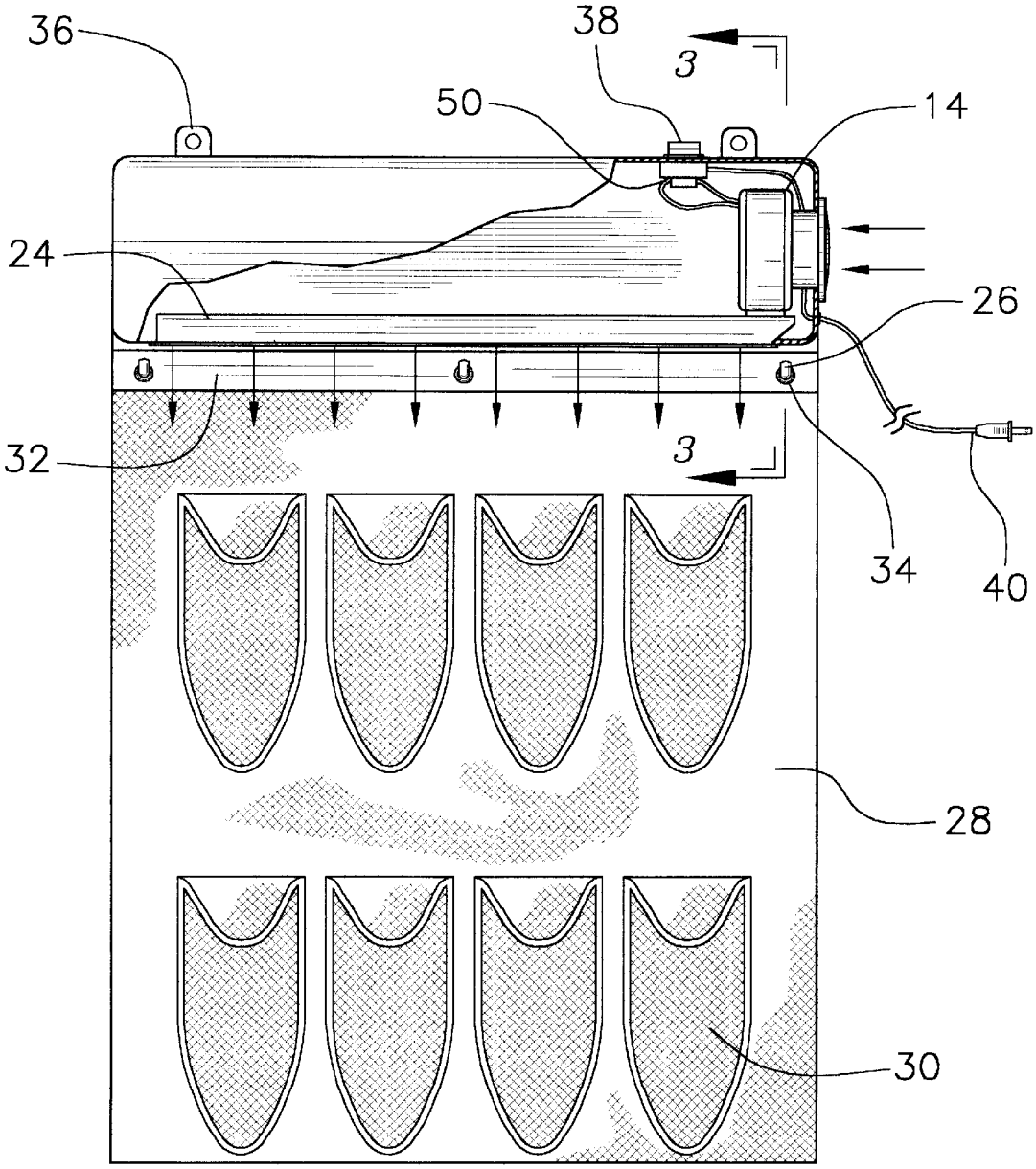
FIG. 2 is a front plan view of the shoe dryer of the present invention.

FIG. 2 is a front view of the shoe dryer 10, which shows the motorized fan assembly 18 and the air discharge duct 28. The air discharge duct 28 is a piece of metal ductwork that extends the entire width of the shoe dryer 10. The air discharge duct 28 is located directly above the flat planar support member 34. The air discharge duct 28 disperses the deodorized air over the shoes that are housed within the mesh pockets 36 of the flat planar support member 34. A manual power switch 44 is located at the top of the upper housing support member 12. The switch 38 is connected to a power cord 46, which can be plugged into an outlet to provide electricity to the shoe dryer 10. When the switch 38 is engaged, air is taken in through the intake screen 42 where it then passes through the deodorizing filter 16 and into the fan assembly 18. The fan assembly 18 blows the air out through the air discharge duct 28, which then distributes the deodorized air over the shoes that are contained within the mesh pockets 36.

Figure 3:
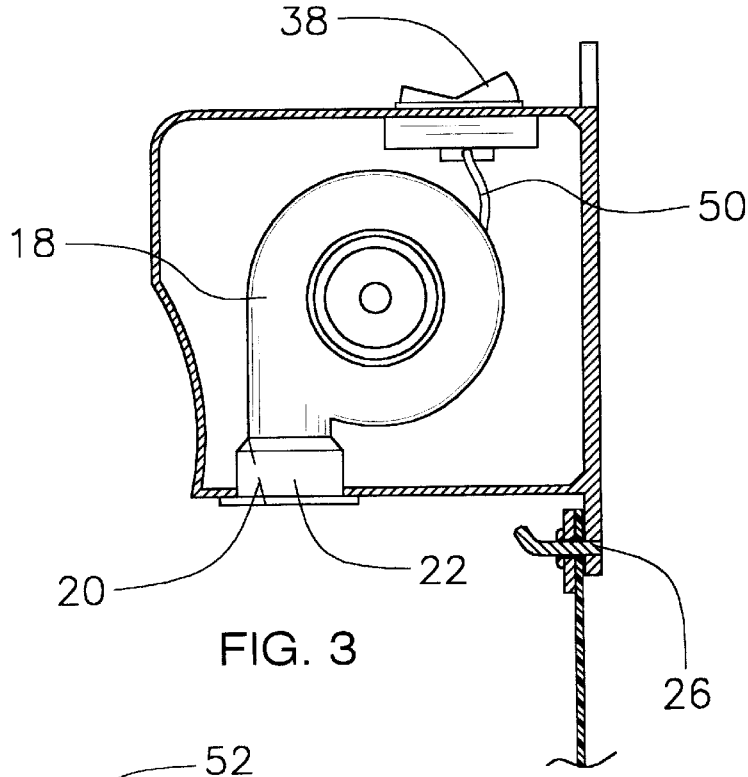
FIG. 3 is a cross sectional view of the shoe dryer showing the fan blower taken substantially along the 3—3 line as described in FIG. 2 of the present invention.

FIG. 3 shows the fan assembly 18 in detail. The power switch 36 is connected to the fan assembly 18. The fan assembly 18 consists of a fan intake duct 20, fan blower 22, a baffle 24, and a fan discharge duct 26. Air is taken in through the fan intake duct 20, which is directly connected to the fan blower 22. The fan blower 22 is the mechanism that pushes the air through the fan assembly 18. The bottom end of the fan blower 22 is connected to the top end of the fan discharge duct 26. A baffle 24 is located between the bottom end of the fan blower 22 and the top end of the fan discharge duct 26 to regulate the amount of air that flows through the fan discharge duct 26. The bottom end of the fan discharge duct 26 is connected to the top end of the air discharge duct 28. The fan discharge duct 26 is the duct that distributes the air to the air discharge duct 28 so that it can be dispersed over the shoes. This figure also shows the placement of the hangar hooks 32 on the flange 30 of the upper housing support member 12. The hangar hooks 32 extend outwardly from the flange 30. The hangar hooks 32 are preferably manufactured of metal but a durable plastic could also be used.

Figure 4:
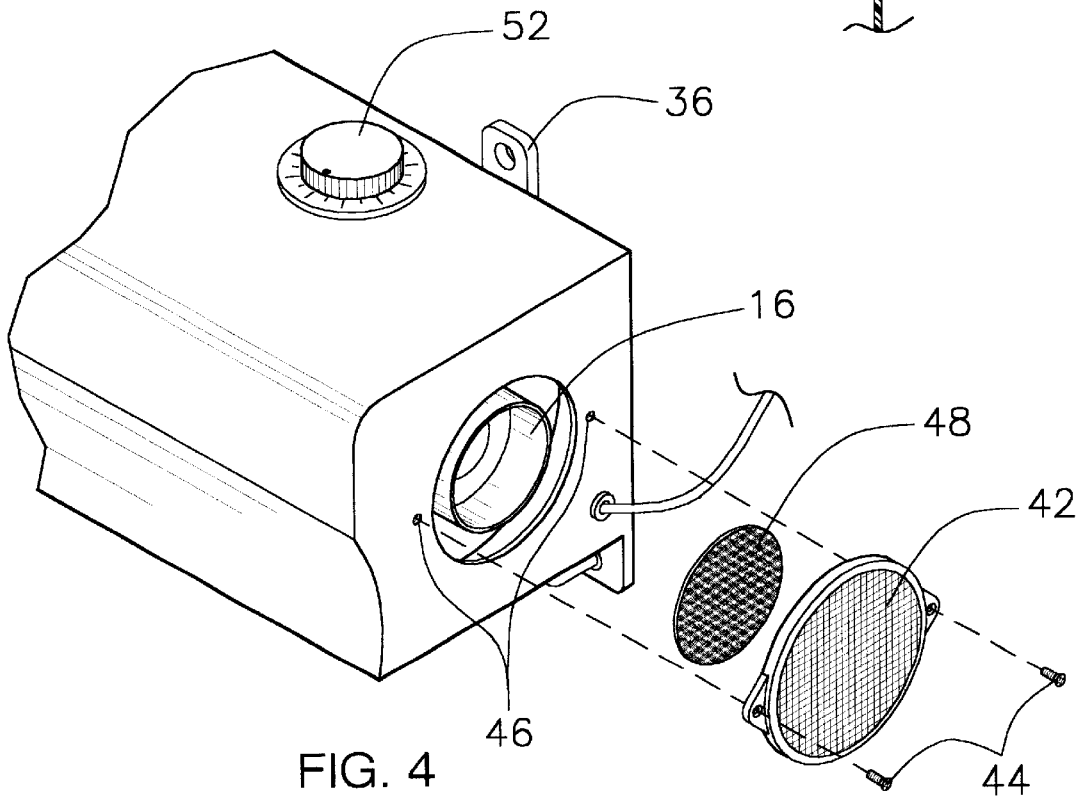
FIG. 4 is a top right perspective view of the second embodiment of the shoe dryer of the present invention showing the timer mechanism and the deodorizing filter.

FIG. 4 shows a second embodiment of the present invention in which a timer mechanism 52 is used. The use of a timer mechanism 52 eliminates the need for a power switch 38, by providing an automatically timed use of the shoe dryer 10. The timer mechanism 52 could be set to automatically turn the shoe dryer 10 on or off. The timer mechanism 52 would also be connected to the power cord 46, which is then connected to an outlet to supply electricity to the shoe dryer 10. This figure also shows the removal of the air intake screen 14 and the placement of the deodorizing filter 16. The air intake screen 14 is held in place by screws 48 that fit into matching attachment points 50 in the upper housing support member 12. When the screws 48 are removed, the air intake screen 14 can be removed and the deodorizing filter 16 can be replaced. The deodorizing filter 16 is positioned directly behind the intake screen 42 so that the air is deodorized before it reaches the shoes. Air passes through the intake screen 42 and the deodorizing filter 16 and enters the fan intake duct 20. From there it is cycled through the fan assembly 18 and out the air discharge duct 28 to the shoes in the mesh pockets 36.

While a preferred embodiment of the shoe dryer has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An apparatus comprising:

an upper housing support member having a top side, a bottom side, a front side, a back side, a left side, and a right side;

an air intake screen connected to said right side of said upper housing support member;

a deodorizing filter, said deodorizing filter contained within said air intake screen;

a motorized fan assembly, comprised of a fan intake duct positioned behind said air intake screen and connected to a blower, wherein the bottom end of said blower is connected to the top end of a fan discharge duct, wherein a baffle is positioned between said bottom end of said blower and said top end of said fan discharge duct;

an air discharge duct located in said bottom side of said upper housing support member and connected to the bottom end of said fan discharge duct, wherein said air discharge duct extends the width of said upper housing support member;

a flange, wherein said flange extends downward from the juncture of said bottom side and said back side of said upper housing support member;

a plurality of hangar hooks, wherein said hangar hooks are connected to the front side of said flange and extend outwardly therefrom;

a hangar bar located at the top of a flat planar support member wherein said hangar bar defines a plurality of attachment slots that are spaced to mate with said hangar hooks;

a flat planar support member having a plurality of pockets attached thereto, wherein said flat planar support member hangs directly downward from said upper housing support member when said hangar hooks are inserted into said attachment slots of said hangar bar;

a plurality of mounting brackets, wherein said mounting brackets extend upward from the juncture between said top side and said back side of said upper housing support member;

a manual power switch, wherein said power switch is connected by an electrical circuit to said motorized fan assembly and an electrical cord;

an electrical cord for providing electrical current to the said manual power switch, wherein said electrical cord protrudes from said right side of said upper housing support member and is connected to said manual power switch by an electrical circuit.

2. The apparatus of claim 1, wherein said upper housing support member is manufactured of a metal.

3. The apparatus of claim 1, wherein said air intake screen is removably attached to said upper housing support member right side via screws that fit into matching attachment points in said upper housing support member right side.

4. The apparatus of claim 1, wherein said motorized fan assembly is manufactured of metal.

5. The apparatus of claim 1, wherein said baffle regulates air flow from said blower into said fan discharge duct.

6. The apparatus of claim 1, wherein said hangar hooks are metal.

7. The apparatus of claim 1, wherein said pockets are mesh.

8. The apparatus of claim 1, wherein said mounting brackets are metal.

9. An apparatus comprising:

an upper housing support member having a top side, a bottom side, a front side, a back side, a left side, and a right side;

an air intake screen connected to said right side of said upper housing support member;

a deodorizing filter, said deodorizing filter contained within said air intake screen;

a motorized fan assembly, comprised of a fan intake duct positioned behind said air intake screen and connected to a blower, wherein the bottom end of said blower is connected to the top end of a fan discharge duct, wherein a baffle is positioned between said bottom end of said blower and said top end of said fan discharge duct;

an air discharge duct located in said bottom side of said upper housing support member and connected to the bottom end of said fan discharge duct, wherein said air discharge duct extends the width of said upper housing support member;

a flange, wherein said flange extends downward from the juncture of said bottom side and said back side of said upper housing support member;

a plurality of hangar hooks, wherein said hangar hooks are connected to the front side of said flange and extend outwardly therefrom;

a hangar bar located at the top of a flat planar support member wherein said hangar bar defines a plurality of attachment slots that are spaced to mate with said hangar hooks;

a flat planar support member having a plurality of pockets attached thereto, wherein said flat planar support member hangs directly downward from said upper housing support member when said hangar hooks are inserted into said attachment slots of said hangar bar;

a plurality of mounting brackets, wherein said mounting brackets extend upward from the juncture between said top side and said back side of said upper housing support member;

a timer mechanism, wherein said timer mechanism is connected by an electrical circuit to said motorized fan assembly and an electrical cord;

an electrical cord for providing electrical current to the said timer mechanism, wherein said electrical cord protrudes from said right side of said upper housing support member and is connected to said timer mechanism by an electrical circuit.

10. The apparatus of claim 9, wherein said upper housing support member is manufactured of a metal.

11. The apparatus of claim 9, wherein said air intake screen is removably attached to said upper housing support member right side via screws that fit into matching attachment points in said upper housing support member right side.

12. The apparatus of claim 9, wherein said motorized fan assembly is manufactured of metal.

13. The apparatus of claim 9, wherein said baffle regulates air flow from said blower into said fan discharge duct.

14. The apparatus of claim 9, wherein said hangar hooks are metal.

15. The apparatus of claim 9, wherein said pockets are mesh.

16. The apparatus of claim 9, wherein said mounting brackets are metal.

17. An apparatus comprising:

an upper housing support member, manufactured of a metal, wherein said upper housing support member has a top side, a bottom side, a front side, a back side, a left side, and a right side;

an air intake screen connected to said right side of said upper housing support member, said air intake screen being removably attached via screws that fit into matching attachment points in said upper housing support member right side;

a deodorizing filter contained within said air intake screen;

a motorized fan assembly, manufactured of metal and comprised of a fan intake duct positioned behind said air intake screen and connected to a blower, wherein the bottom end of said blower is connected to the top end of a fan discharge duct, wherein a baffle is positioned between said bottom end of said blower and said top end of said fan discharge duct to regulate air flow to said fan discharge duct;

an air discharge duct located within said bottom side of said upper housing support member and connected to the bottom end of said fan discharge duct, wherein said air discharge duct extends the width of said upper housing support member;

a flange, wherein said flange extends downward from the juncture of said bottom side and said back side of said upper housing support member;

a plurality of metal hangar hooks which protrude outwardly from the front side of said flange portion of said upper housing support member;

a metal hangar bar located at the top of a flat planar support member wherein said hangar bar defines a plurality of attachment slots that are spaced to mate with said hangar hooks;

a flat planar support member having a plurality of mesh pockets attached thereto, wherein said flat planar support member hangs directly downward from said upper housing support member when said hangar hooks are inserted into said attachment slots of said hangar bar;

a plurality of metal mounting brackets, wherein said mounting brackets extend upward from the juncture between said top side and said back side of said upper housing support member;

a timer mechanism, wherein said timer mechanism is connected by an electrical circuit to said motorized fan assembly and an electrical cord;

an electrical cord for providing electrical current to the said timer mechanism, wherein said electrical cord protrudes from said right side of said upper housing support member and is connected to said timer mechanism by an electrical circuit.

* * * * *